US005655925A

United States Patent [19]

Pon

[11] Patent Number: 5,655,925

[45] Date of Patent: Aug. 12, 1997

[54] FEMALE PLUG

[76] Inventor: Su-Chin Pon, No. 1, Alley 2, Lane 94, Po Ei Street, Hsinchu CIty, Taiwan

[21] Appl. No.: 493,281

[22] Filed: Jun. 21, 1995

[51] Int. Cl.[6] ..... H01R 4/24

[52] U.S. Cl. ..... 439/395; 439/651; 439/404

[58] Field of Search ..... 439/395, 404, 439/622, 676, 651

[56] References Cited

U.S. PATENT DOCUMENTS

| | | | |
|---|---|---|---|
| 4,153,326 | 5/1979 | Frantz et al. | 439/404 |
| 4,560,226 | 12/1985 | Dennis | 439/395 |
| 4,778,405 | 10/1988 | Sterken | 439/395 |
| 4,859,203 | 8/1989 | Eckhaus | 439/404 |
| 4,909,753 | 3/1990 | Siemon et al. | 439/395 |
| 4,932,893 | 6/1990 | Rudoy | 439/395 |
| 4,969,839 | 11/1990 | Nilsson | 439/395 |
| 5,427,544 | 6/1995 | Okabe | 439/395 |
| 5,433,626 | 7/1995 | Drewanz et al. | 439/395 |
| 5,451,173 | 9/1995 | Mai | 439/651 |

FOREIGN PATENT DOCUMENTS

| | | | |
|---|---|---|---|
| 405630 | 1/1991 | European Pat. Off. | 439/404 |

*Primary Examiner*—Gary E. Elkins
*Attorney, Agent, or Firm*—Varndell Legal Group

[57] ABSTRACT

A female plug including an insulative base block, two contact blades mounted in respective grooves on the base block and connected to a two-line electric wires. An insulative housing surrounds the base block to hold down the contact blades. The base block has receiving chambers and circularly notched upright ribs to receive and support the lead ends of the two-line electric wires, and a plurality of transverse ribs to hold down the contact blades. The contact blades have a respective pointed tip, which is forced into one of the lead ends of two-line electric wire to make a respective electric contact when the two-line electric wire is installed and the housing.

1 Claim, 5 Drawing Sheets

FEMALE PLUG

BACKGROUND AND SUMMARY OF THE INVENTION

The present invention relates to a electric plug, and relates more particularly to a female plug which is easy to assemble without stripping off the insulator of the electric wire.

A female plug is an electric plug intensively used in decorative light strings for connection to a male plug. FIGS. 1, 2, and 3 show a female plug according to the prior art. This structure of female plug is comprised of an insulative base block, two contact blades mounted in respective grooves on the base block and connected to a two-line electric wire, and an insulative housing covered around the base block to hold down the contact blades. Before the installation of the contact blades, the insulators of the lead ends of the two lines of the two-line electric wire must be stripped off so that the conductors of the two lines of the two-line electric wires can be fastened to the contact blades respectively. This complicated assembly process greatly increases the manufacturing cost of the female plug.

The present invention has been accomplished to provide a female plug which eliminates the aforesaid drawback. According to one aspect of the present invention, the base block has receiving chambers and circularly notched upright ribs to receive and support the lead ends of the two lines of the two-line electric wires, and a plurality of transverse ribs to hold down the contact blades. According to another aspect of the present invention, the contact blades have a respective pointed tip, which is forced into one line of the two-line electric wire to make a respective electric contact when the two-line electric wire is installed and the housing is covered around the base block.

DETAILED DESCRIPTION OF THE PREFERRED EMBODIMENT

Figure 1:
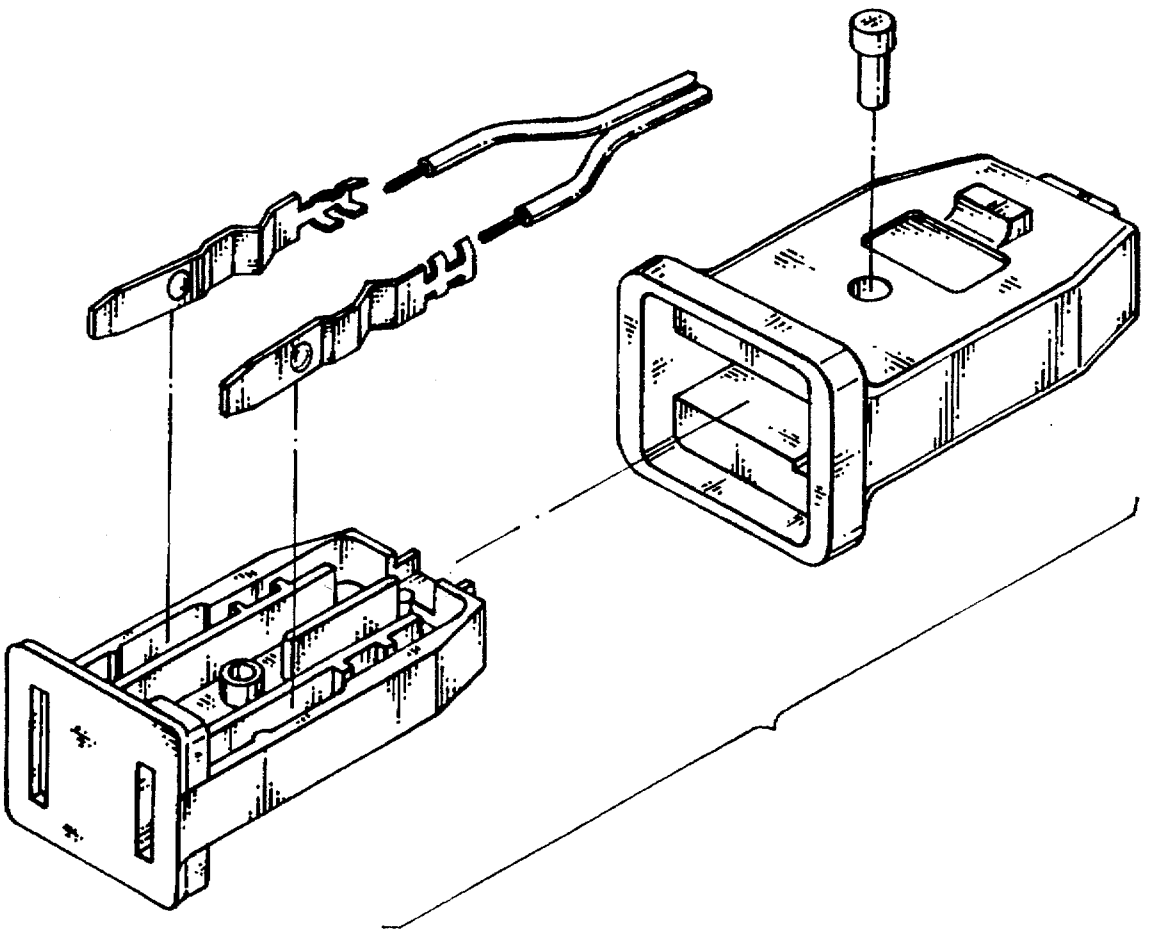
Fig. 1 PRIOR ART
FIG. 1 is an exploded view of a female plug according to the prior art.
Figure 3:
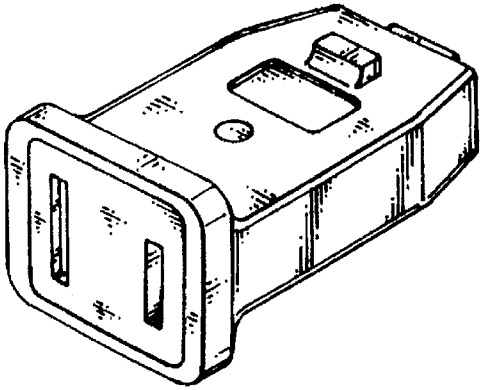
Fig. 3 PRIOR ART
FIG. 3 is an elevational view of the female plug shown in FIG. 1.
Figure 2:
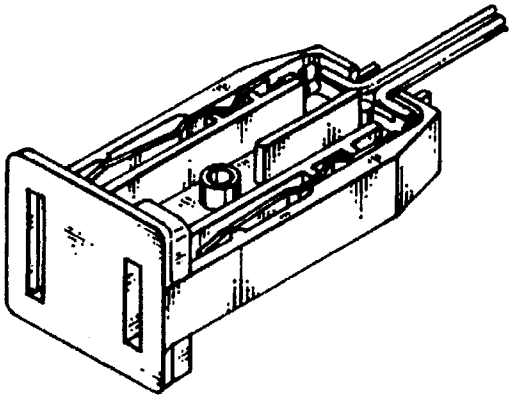
Fig. 2 PRIOR ART
FIG. 2 is an assembly view of the female plug shown in FIG. 1 before the mounting of the insulative housing.
Figure 4:
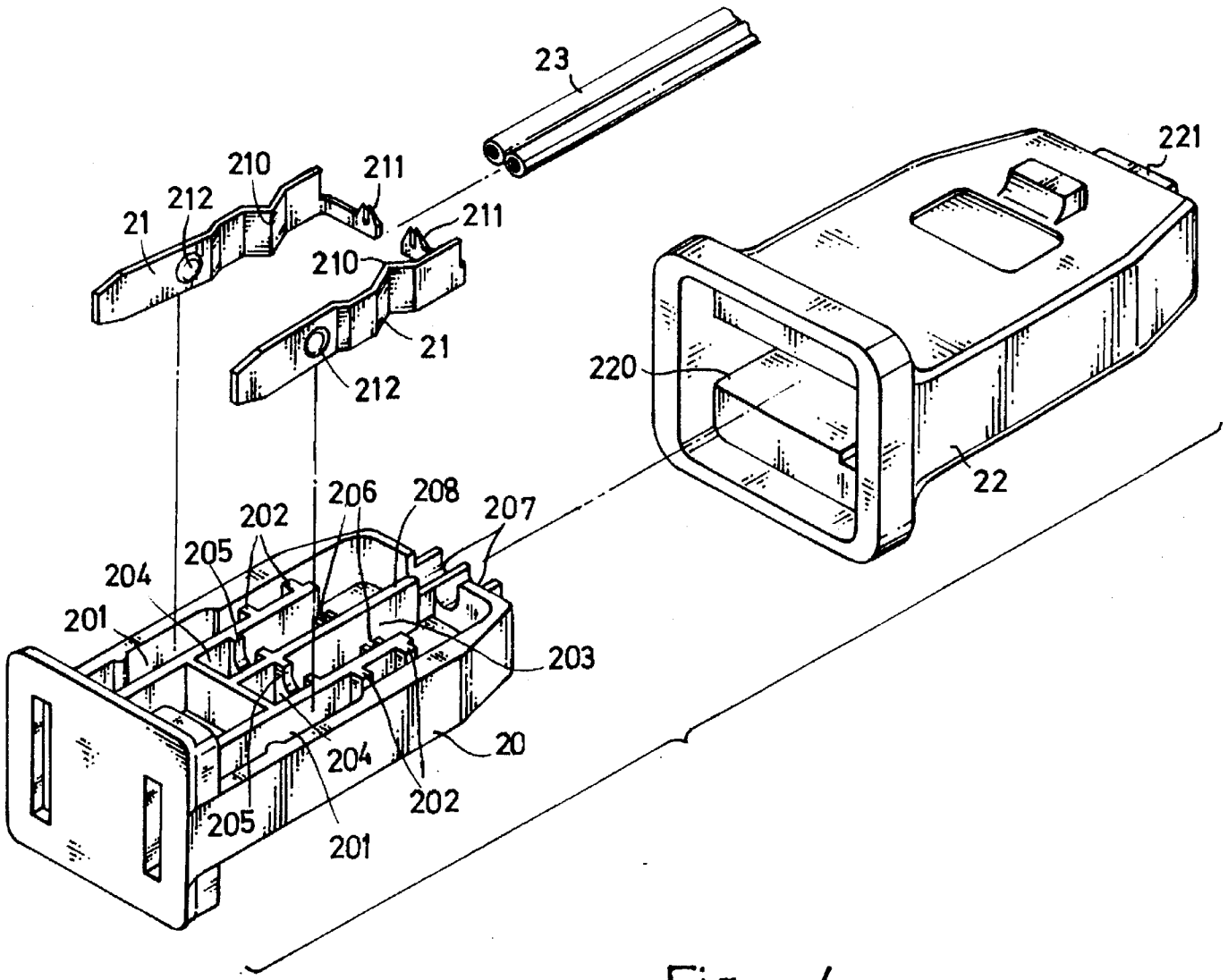
FIG. 4 is an exploded view of a female plug according to the present invention.
Figure 7:
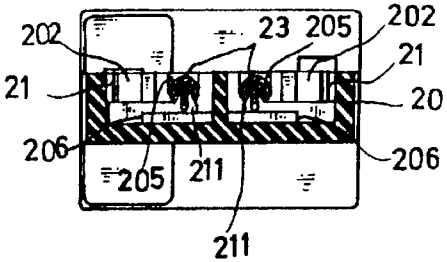
FIG. 7 is a sectional taken along line 7—7 of FIG. 5.
Figure 6:
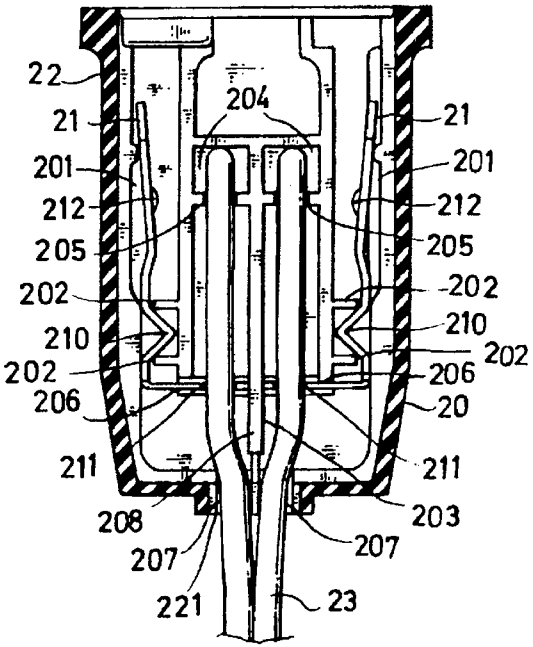
FIG. 6 is a top plain view of FIG. 6.
Figure 5:
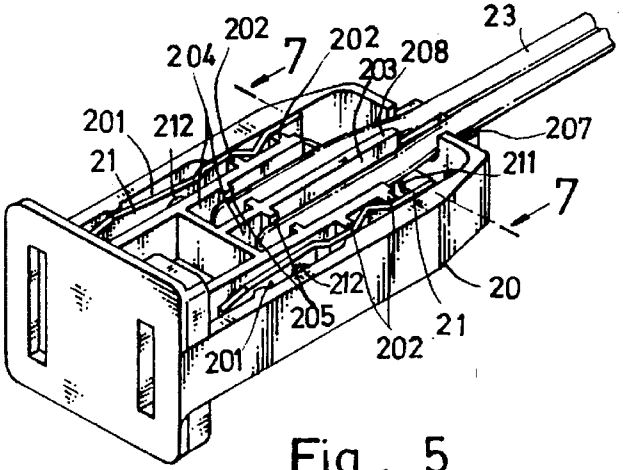
FIG. 5 is an assembly view of the female plug shown in FIG. 4 before the mounting of the insulative housing.
Figure 9:
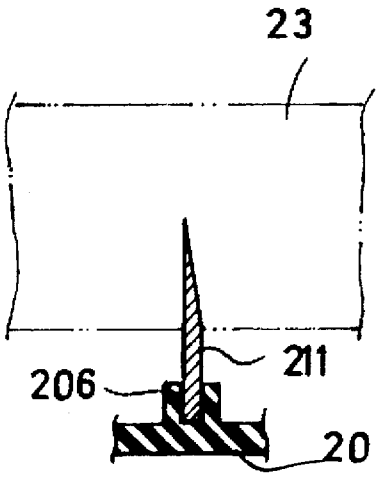
FIG. 9 is a sectional view showing the pointed tip of the contact blade protruded over the top side of the base block and forced into the electric wire.
Figure 8:
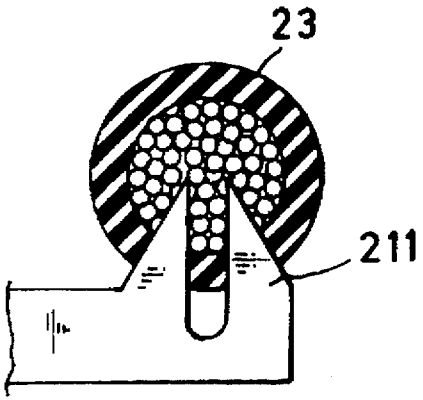
FIG. 8 is a sectional view in an enlarged scale showing the pointed tip of one contact blade forced into the conductor of one line of the electric wire.

Referring to FIGS. 4 and 5, a female plug in accordance with the present invention is generally comprised of an insulative base block 20, two symmetrical contact blades 21 respectively fastened to the insulative base block 20, an insulative housing 22 covered around the insulative base block 20 to hold the contact blades 21 in place, and a two-line electric wire 23 inserted through the flanged rear port 221 on the insulative housing 22 and connected to the contact blades 21. The base block 20 comprises two longitudinal outer grooves 211 bilaterally extended to the front end thereof for receiving the contact blades 21 respectively, a plurality of transverse projecting ribs 202 in the longitudinal outer grooves 211 for stopping the contact blades 21 in place, a longitudinal partition wall 208 longitudinally disposed in the middle, two longitudinal inner grooves 203 disposed in parallel between the longitudinal outer grooves 211 and separated by the longitudinal partition wall 208 for receiving the two-line electric wire 23, two receiving chambers 204 respectively disposed at the inner end of each longitudinal inner groove 203 for receiving the lead ends of the two lines of the two-line electric wire 23, two circularly notched upright ribs 205 respectively disposed between the longitudinal inner grooves 203 and the receiving chamber 204 for supporting the lead ends of the two lines of the two-line electric wire 23, two openings 206 respectively communicated between the longitudinal inner grooves 203 and the longitudinal outer grooves 201, and a rear flange 207 raised from the rear end thereof around the longitudinal inner grooves 203. The contact blades 21 are respectively inserted into the longitudinal outer grooves 201, each comprising a raised contact portion 212 near the front end for the contact of one contact blade of a male plug (not shown), a bend 210 in the middle retained to the transverse ribs 202 in one longitudinal outer groove 201, and a pointed tip 211 at the rear end disposed in one opening 206. The insulative housing 22 has a front chamber 220, which receives the base block 20, and a flanges rear port 221, which receives the rear flange 207 of the base block 20.

Referring to FIGS. 6, 7, 8, and 9, and FIG. 4 again, when the contact blades 21 are respectively inserted into the longitudinal outer grooves 201, the two lead ends of the two lines of the two-line electric wire 23 are inserted through the flanged rear port 221 of the insulative housing 22 and then respectively inserted into the longitudinal inner grooves 203 and the receiving chambers 203 and supported on the circularly notched upright ribs 205 and the pointed tips 211 of the contact blades 21, and then the insulative housing 22 is covered around the base block 20. When the base block 20 is forced into the insulative housing 22, the two lines of the two-line electric wire 23 are squeezed downwards against the pointed tips 211 of the contact blades 21, causing the pointed tips 211 forced into the conductors of the two lines of the two-line electric wire 23 to make a respective electric contact.

I claim:

1. A female plug comprising an insulative housing with a front, a rear flange, and a chamber longitudinally arranged and extending from said rear flange and open at said front, an insulative base block completely received within said chamber of said insulative housing, two contact blades secured in said base block inside said housing, and a two-line wire with two leads respectively connected to said contact blades, said insulative base block including a rear flange received in said rear flange of said insulative housing;

said base block further having a front end and an outer surface, two longitudinally extending inner walls with a top and bottom touching said insulative housing and bilaterally extending from said rear flange of said base block to said front end of said base block, a longitudinally extending middle wall having a top and a bottom touching said insulative housing, said inner walls and said outer surface of said base block forming outer grooves bilaterally extending from said rear flange of said base block to said front end of said base block, a plurality of transversely projecting ribs arranged in said longitudinal outer grooves, said middle wall and said inner walls forming longitudinal inner grooves disposed in parallel for receiving said two leads of said two-line electric wire, said middle wall having a front with a transversely arranged front wall, said front wall and said middle wall forming two receiving chambers respectively receiving said leads of said two-line electric wire and insulating said leads from each other, two concave upright ribs respectively disposed in said receiving chamber for supporting and holding said leads, two openings arranged in said rear flange of said base block and respectively communicating with both said longitudinal inner grooves and said longitudinal outer grooves;

said contact blades are respectively inserted into said longitudinal outer grooves, each said contact blade respectively having a first end, a middle, and a second end; said first end having a raised contact portion for contacting one contact blade of a male plug, said middle having a bend for holding said contact blade in place by interaction with said transverse ribs in one of said longitudinal outer grooves, and said second end having pointed tips arranged in one of said openings of one said base block, said pointed tips respectively piercing into and located within said two leads, wherein said leads are arranged and held in said inner grooves when said base is detached from said housing, and when said base is slid into said chamber of said housing said pointed tips of said contact blades are forced into said leads.

* * * * *